United States Patent [19]

Ikenoue et al.

[11] 4,045,227

[45] Aug. 30, 1977

[54] METHOD FOR STABILIZING SILVER HALIDE PHOTOGRAPHIC MATERIAL

[75] Inventors: Shinpei Ikenoue; Eiichi Mizuki, both of Asaka, Japan

[73] Assignee: Fuji Photo Film Co., Ltd., Minami-ashigara, Japan

[21] Appl. No.: 385,268

[22] Filed: Aug. 3, 1973

[30] Foreign Application Priority Data

Aug. 4, 1972 Japan ..... 47-7820872

[51] Int. Cl.[2] ..... G03C 5/38; G03C 1/28

[52] U.S. Cl. ..... 96/61 R; 96/108; 96/110; 96/119 PQ

[58] Field of Search ..... 96/61 R, 119 PQ, 95, 96/107, 108, 94 R, 110

[56] References Cited

U.S. PATENT DOCUMENTS

| | | | |
|---|---|---|---|
| 1,582,050 | 4/1926 | Johnson | 96/61 R |
| 2,083,675 | 6/1937 | Ville | 96/61 R |
| 3,033,678 | 5/1962 | Hunt | 96/119 PQ |
| 3,047,392 | 7/1962 | Scott | 96/108 |
| 3,109,737 | 11/1963 | Scott | 96/119 PQ |
| 3,143,419 | 8/1964 | Gilman | 96/119 PQ |
| 3,210,189 | 10/1965 | von Wartburg | 96/61 R |
| 3,418,122 | 12/1968 | Colt | 96/63 |
| 3,561,971 | 2/1971 | Pestalozzi | 96/119 PQ |

FOREIGN PATENT DOCUMENTS

| | | | |
|---|---|---|---|
| 1,160,956 | 8/1969 | United Kingdom | 96/107 |

OTHER PUBLICATIONS

1954 Photographic Engineering, vol. 5, No. 2, pp. 127-132.

*Primary Examiner*—Mary F. Kelley
*Attorney, Agent, or Firm*—Sughrue, Rothwell, Mion, Zinn and Macpeak

[57] ABSTRACT

A method of stabilizing a silver halide photographic material containing an image formed therein, said material comprising a silver halide emulsion on a support and having at least one member selected from the group consisting of iodine and an iodine containing inorganic compound in said silver halide emulsion or in an adjacent layer to said silver halide emulsion, comprising heating said photographic material.

17 Claims, No Drawings

METHOD FOR STABILIZING SILVER HALIDE PHOTOGRAPHIC MATERIAL

BACKGROUND OF THE INVENTION

1. Field of the Invention

The present invention relates to a method for stabilizing a silver halide photographic material.

2. Description of the Prior Art

Silver halide photographic materials are usually processed as follows: first, latent images formed by exposure are developed, and then the photographic materials are subjected to fixation processing to convert the undeveloped light-sensitive silver halide to a water-soluble silver salt. The water-soluble silver salt is then washed away with water.

In shortening the processing involved in this fixing and water-washing processing, the so-called stabilizing processing is known wherein the undeveloped silver halide is converted into a silver complex compound which is not light sensitive.

This stabilizing processing is conducted by immersing a photographic material in an aqueous solution containing a complex salt-forming agent. However, stabilizing processing utilizing such an aqueous solution is sometimes unsuitable, particularly for a silver halide photographic materials which are to be subjected to dry development processing.

SUMMARY OF THE INVENTION

It is, therefore, an object of the present invention to provide a simple stabilizing method requiring no drying step as described above.

Another object of the present invention is to provide a dry stabilizing method which does not utilize an aqueous or nonaqueous stabilizing bath.

As a result of various investigations to attain the abovedescribed objects, the inventors have achieved the present invention. That is, the present invention comprises a method for stabilizing a silver halide photographic material comprising heating a silver halide photographic material having incorporated therein at least one member selected from the group consisting of iodine and iodine-containing inorganic compounds in the silver halide emulsion layer or in an adjacent layer thereof provided on the support.

DETAILED DESCRIPTION OF THE INVENTION

As the silver halide used in the present invention, silver bromide, silver chloride, silver chlorobromide, silver bromoiodide, silver chlorobromoiodide, and the like are suitable. In particular, silver halides comprising at least 50 mol % of silver bromide are preferred.

As the binder for a silver halide emulsion containing the silver halide, those conventionally known may be used. More specifically, suitable binders are, for example, gelatin, gelatin derivatives such as phthaloylated gelatin, polyvinyl alcohol, hydroxymethyl cellulose, carboxymethyl cellulose, and the like. The amount of silver halide present in the binder can vary widely and the amount thereof can be freely selected. Generally, the amount of silver halide ranges 1:10 to 3:1, preferably from 1:4 to 2:1, by weight to the amount of binder.

Suitable iodine-containing inorganic compounds which can be used in the invention are inorganic compounds containing a positive mono- tri-, penta- or heptavalent iodine bonded to an atom more negative than iodine, i.e., fluorine, chlorine, bromine or oxygen and inorganic compounds (inorganic iodides) containing negative monovalent iodine bonded to an atom more positive than iodine. Specific examples of such inorganic iodine-containing compounds include, e.g., potassium iodide, sodium iodide, calcium iodide, magnesium iodide, ammonium iodide, nickel iodide, rubidium iodide, cesium iodide, lithium iodide, manganese iodide, barium iodide, chromium iodide, hydrogen iodide, silver iodide, iodic acid, periodic acid, iodine chloride, potassium iodate, sodium iodate, sodium periodate, and the like. These iodine-containing inorganic compounds and iodine may be used in combination if desired. Such iodine-containing compounds or iodine are generally incorporated in a silver halide emulsion layer, but they may also be incorporated in an adjacent layer to the silver halide emulsion layer. The iodine-containing compounds or iodine can also be incorporated in both the silver halide layer and an adjacent layer.

The amount of the iodine-containing compound or iodine which is used ranges from 0.1 to 100 mol%, preferably from 0.5 to 50 mol% based on the molar amount of silver halide. If the amount used is too small, sufficient stabilization to light cannot be attained, while the amount used is too large, the sensitivity is lowered.

Where a water-soluble inorganic iodide is in a silver halide emulsion to be incorporated, it is preferable to add the water-soluble inorganic iodide during the period of time between the formation of silver halide grains or the completion of the change in grain size or in form in the preparation of a silver halide emulsion and the time immediately before coating the emulsion on a support. It is believed that the size and form of the silver halide grains do not change very much after physical ripening. Therefore, where physical ripening is conducted in the preparation of a silver halide emulsion, it is preferable to add the water-soluble inorganic iodide during the period between the physical ripening and the time just before coating the emulsion.

Where iodine-containing inorganic compounds other than the water-soluble inorganic iodides are used or where iodine is used, they may be added to the emulsion in any stage of the preparation thereof. Preferably, the addition is conducted in the same period as in the case of the above-described water-soluble inorganic iodides.

If desired, various additives such as hardeners (e.g., chromium alum, etc., as disclosed in C.E.K. Mees & T.H. James. The Theory of the Photographic Process, Vol. 3, (1966) page 55–60, U.S. Pat. Nos. 3,316,095; 3,232,764; 3,288,775; 2,732,303; 3,635,718; 3,232,763; 2,732,316; 2,586,168; 3,103,437; 3,017,280; 2,983,611; 2,725,294; 2,725,295; 3,100,704; 3,091,537; 3,321,313 and 3,543,292, British Pat. Nos. 974,723; 994,869 and 1,167,027), surface active agents (e.g., sodium laurylsulfonate, saponin, anionic compounds such as the alkylarylsulphonates which are described in U.S. Pat. No. 2,600,831 and amphoteric compounds which are described in U.S. Pat. No. 3,133,816, etc.) plasticizers (e.g., glycerin, etc.), sensitizing dyes as disclosed in F.M. Hamer, "The Cyanine Dyes and Related Compounds", and the like, can be additionally added to the silver halide emulsion used in the present invention and then the emulsion is applied to a support. The thickness of the silver halide emulsion layer preferably ranges from 1 to 100 microns or, on the basis of the silver, from 5 to 100 mg/100 $cm^2$.

As the support to be used in the present invention, those which are conventionally known as photographic supports can be used. To be specific, there are mentioned, for example, films of nitrocellulose, cellulose acetate (e.g., cellulose diacetate, cellulose triacetate, etc.), polyvinyl acetal, polystyrene, polyester (e.g., polyethylene terephthalate, etc.) or like plastics, glass plates, papers, papers laminated with a resin such as polyethylene or polypropylene, metal plates, and the like.

The above-described iodine or iodine-containing inorganic compounds used in the invention can also be applied using an immersion method. That is, they can also be applied by immersing a silver halide emulsion layer or, if an adjacent layer is provided, the adjacent layer in an aqueous layer in an aqueous solution of the abovedescribed compounds or a solution thereof in an organic solvent such as acetone, methanol, 2-methoxyethanol, dimethylsulfoxide, dimethylformamide etc.

The thus obtained silver halide photographic material can be stabilized to light by simply heating it. That is, before heating, the above-described silver halide photographic material is unstable to light, i.e., printing-out phenomenon occurs (see Mees and James, supra, pp 92–97) but, after heating, coloring due to printing-out does not occur any more, even when the material is left in a brightly lighted room.

Such heat treatment is conducted generally above 80° C, preferably above 120° C, for longer than 1 second, preferably longer than 5 seconds. Generally a time no longer than 60 minutes, more generally, no longer than 15 minutes is required. The heating may be conducted up to the degree where the support or binder is not degraded or carbonized. Generally, a temperature of no higher than about 270° C, preferably 240° C is used.

The method of the invention has the advantages that, since the stabilizing method requires only a mere heating, the operation is very simple and, in addition, since no liquid such as an aqueous solution is used, the steps are markedly reduced in time. Therefore, these advantages become still greater when the stabilizing method of the invention is applied to a system of forming images utilizing a dry method, i.e., a system of utilizing printing-out development, photo-development, heat-development, or the like. However, the stabilizing method of the invention may also be employed as a method for stabilizing images formed using conventional wet development methods. Thus, great advantages can be obtained.

The present invention will now be illustrated in greater detail by reference to several non-limiting examples of preferred embodiments of the invention. Unless otherwise indicated all parts and percents are by weight.

EXAMPLE 1

250 ml of a 1N silver nitrate aqueous solution and 300 ml of a 1N potassium bromide aqueous solution were gradually added with stirring to a gelatin aqueous solution (2% by weight) at 60° C to prepare a silver bromide emulsion. This emulsion was applied to a glass plate in an amount of 30 mg/100 cm² (calculated as silver) followed by drying to prepare Sample A.

On the other hand, potassium iodide was further added to the above-described silver bromide emulsion in an amount of 5 mol % based on the molar amount of silver halide, and the resulting emulsion was applied to a glass plate in an amount of 30 mg/100 cm² (calculated as silver) to prepare Sample B.

Two pieces of Sample A and two pieces of Sample B were imagewise exposed for 5 minutes at an illuminance of 1500 lux using a 20 W fluorescent lamp to form printed-out images. Thereafter, one piece of Sample A and one piece of Sample B were brought into contact with heated iron plate at 250° C for 30 seconds. When these heated pieces of Sample A and Sample B and the non-heated pieces of Sample A and Sample B were exposed to a fluorescent lamp at an illuminance of 1800 lux, three of sample pieces, i.e., the two non-heated pieces of Sample A and Sample B and the heated piece of Sample A, underwent printing-out phenomenon all over to such an extent that the images previously formed became indistinct. However, the heated piece of Sample B underwent no changes in density at the printed-out image areas and at the non-printed-out areas even after two hours. Furthermore, this sample underwent no visible changes even when left for more than 3 weeks in a usual bright room.

EXAMPLE 2

250 ml of a 1 N silver nitrate aqueous solution and 300 ml of an aqueous solution of a mixture of potassium bromide and potassium chloride (containing 0.95 mol of potassium bromide and 0.05 mol of potassium chloride per 1 liter) were gradually added with stirring to a gelatin aqueous solution (2% by weight) at 60° C to prepare a silver cholrobromide emulsion (silver chloride: 5 mol %). The resulting emulsion was divided into four equal portions, and to each portion was added potassium iodide in an amount of 2.5 mol%, 5 mol%, 10 mol% or 20 mol% based on the molar amount of silver halide. Each of the resulting four portions was applied to a glass plate in an amount of 30 mg/100 cm² (calculated as silver) followed by drying. Thus, four samples were prepared.

Each of these samples was imagewise exposed for 10 minutes at an illuminance of 1500 lux using a 20 W fluorescent lamp to form printed-out images and each sample was subsequently brought into contact with heated iron plate at 250° C for 30 seconds. All of the samples were found to be well stabilized to light as in Example 1 and no visible changes were observed in the samples even when they were left in a bright room.

EXAMPLE 3

10 mol%, based on the molar amount of silver halide, of potassium iodide was added to each of four emulsions, two of them being silver chlorobromide emulsions containing 50 mol% and 30 mol%, respectively, of silver chloride for use in photographic papers and the other two of them being emulsions for use in negative materials containing 3.5 mol% and 7 mol%, respectively, of silver iodide. Thereafter, each of these emulsions was applied to a glass plate in an amount of 30 mg/100 cm² (calculated as silver), then dried to prepare 4 samples. Each of these samples was imagewise exposed to form printed-out images, then brought into contact with heated iron plate at 250° C for 30 seconds. Thus, good images stable to light were obtained.

EXAMPLE 4

5 mol%, based on the molar amount of silver halide, of calcium iodide was added to an emulsion prepared as an Example 1. The resulting emulsion was then applied to a glass plate in an amount of 30 mg/100 cm² (calculated as silver) followed by drying to prepare a sample. This sample was imagewise exposed to form a printed-out image and brought into contact with heated iron plate at 250° C for 30 seconds. Thus, the image was well stabilized as in Example 1. Similarly, 4 samples prepared by adding sodium iodide, rubidium iodide, iodine or sodium iodate in place of calcium iodide were well stabilized by heating them.

EXAMPLE 5

Potassium iodide was added to an emulsion prepared as in Example 1 in an amount of 25 mol% based on the molar amount of silver halide. Thereafter, the resulting emulsion was applied to a glass plate in an amount of 30 mg/100 $cm^2$ (calculated as silver) followed by drying to prepare a sample. This sample was imagewise exposed for 5 minutes at an illuminance of 1500 lux using a 20 W fluorescent lamp to form printed-out images. This sample was then cut into four pieces, and each piece was brought into contact with a heated iron plate heated to 140° C, 180° C, 220° C or 250° C for 40 seconds to heat the samples. These four heated pieces were well stabilized as in Example 1 at all of these temperatures.

While the invention has been described in detail and with reference to specific embodiments thereof, it will be apparent to one skilled in the art that various changes and modifications can be made therein without departing from the spirit and scope thereof.

What is claimed is

1. A dry method of stabilizing a silver halide photographic print-out material containing a visible image formed therein against substantial changes in density in non-print-out areas, said visible image being printed-out through an image-wise exposure, said material comprising a silver halide emulsion on a support, which silver halide comprises at least 50 mol % silver bromide, and having at least one member selected from the group consisting of iodine, silver iodide, potassium iodide, sodium iodide, calcium iodide, magnesium iodide, ammonium iodide, nickel iodide, rubidium iodide, cesium iodide, lithium iodide, manganese iodide, barium iodide, chromium iodide, hydrogen iodide, iodic acid, periodic acid, iodine chloride, potassium iodate, sodium iodate and sodium periodate in said silver halide emulsion or in an adjacent layer to said silver halide emulsion, said at least one member being added to said material prior to coating of said silver halide emulsion on said material, comprising heating said photographic material while dry at a temperature above 80° C for more than 1 second after said visible image is printed-out.

2. The method of claim 1, wherein said member is in the silver halide emulsion.

3. The method of claim 1, wherein said member is in said adjacent layer.

4. The method of claim 1, wherein said iodine containing inorganic compound is a compound in which the iodine is bonded to an atom more electropositive than the iodine and in which the oxidation state of the iodine is $-1$.

5. The method of claim 1, wherein said iodine containing inorganic compound is a compound in which the iodine is bonded to an atom more electronegative than the iodine and in which the oxidation state of the iodine is $+1$, $+2$, $+3$, $+5$ or $+6$.

6. The method of claim 4, wherein said iodine containing inorganic compound is potassium iodide, sodium iodide, calcium iodide, magnesium iodide, ammonium iodide, nickel iodide, rubidium iodide, cesium iodide, lithium iodide, manganese iodide, barium iodide, chromium iodide, hydrogen iodide, or silver iodide.

7. The method of claim 5, wherein said iodine containing inorganic compound is iodic acid, periodic acid, iodine chloride, potassium iodate, sodium iodate, or sodium periodate.

8. The method of claim 1, where said member is present in said emulsion or said adjacent layer at a level of from 0.1 to 100 mol % based on the molar amount of said silver halide.

9. The method of claim 9, wherein said silver halide is present on said support at a level of from 5 to 100 mg/100 $cm^2$ based on the silver.

10. The method of claim 1, wherein said heating is at a temperature above 120° C for more than 5 seconds.

11. The method of claim 8, wherein said member is present at a level of from 0.5 to 50 mol percent based on the moler amount of said silver halide.

12. The method of claim 1, wherein stabilizing consists of the step of heating said image-wise exposed material containing said printed-out visible image.

13. The method of claim 1, wherein said material consists essentially of the recited components.

14. The method of claim 1, wherein said at least one member is iodine.

15. The method of claim 1, wherein said iodine containing inorganic components is an alkali metal or alkaline earth metal iodine.

16. The method of claim 1, wherein said iodine containing inorganic compound is potassium iodide.

17. The method of claim 1, wherein said iodine containing inorganic compound is calcium iodide.

* * * * *